US005808418A

United States Patent [19]

Pitman et al.

[11] Patent Number: 5,808,418

[45] Date of Patent: Sep. 15, 1998

[54] CONTROL MECHANISM FOR REGULATING THE TEMPERATURE AND OUTPUT OF A FLUORESCENT LAMP

[75] Inventors: Bruce A. Pitman; Richard M. Meldrum, both of Phoenix, Ariz.

[73] Assignee: Honeywell Inc.

[21] Appl. No.: 966,101

[22] Filed: Nov. 7, 1997

[51] Int. Cl.[6] ..... H01J 7/24

[52] U.S. Cl. ..... 315/115; 315/117; 315/118; 313/44

[58] Field of Search ..... 313/493, 607, 313/44, 15, 234, 594, 33, 20; 315/115, 112, 113, 114, 116, 117, 118

[56] References Cited

U.S. PATENT DOCUMENTS 4,005,332 1/1977 Gallo et al. .
4,070,570 1/1978 Wetmore et al. .
4,518,895 5/1985 Lehman .
4,529,912 7/1985 Northrup et al. .
4,533,853 8/1985 Hammond et al. .
4,533,854 8/1985 Northrup .
4,694,215 9/1987 Hofman .
5,274,305 12/1993 Bouchard ..... 315/108
5,581,157 12/1996 Vrionis .
5,646,702 7/1997 Akinwande et al. .

*Primary Examiner*—Robert J. Pascal
*Assistant Examiner*—David H. Vu
*Attorney, Agent, or Firm*—Thomas A. Rendos

[57] ABSTRACT

Disclosed is a control mechanism for regulating the temperature of a fluorescent lamp tube located within a housing. The control mechanism includes a cold spot mechanism defining the cold spot of the lamp tube, a heating mechanism, a power supply and a temperature sensor. The heating mechanism is connected to the power supply and is contiguous with a portion of the cold spot mechanism located outside of the housing. The temperature sensor is also coupled to the power supply and monitors the temperature of the cold spot mechanism. Based upon the temperature of the cold spot mechanism, the temperature sensor operates the power supply, so as to deliver power to the heating mechanism to warm the cold spot mechanism and maintain a cold spot temperature that allows the lamp tube to generate maximum visible light output.

11 Claims, 6 Drawing Sheets

CONTROL MECHANISM FOR REGULATING THE TEMPERATURE AND OUTPUT OF A FLUORESCENT LAMP

BACKGROUND OF THE INVENTION

This invention relates to electronic displays. In particular, the present invention is a control mechanism for regulating the cold spot temperature of a hot cathode, fluorescent discharge lamp that functions as a backlight for a liquid crystal display for an avionics device.

In the aviation and space industries, electronic displays have been used to display information. The most widely used electronic display is the cathode ray tube (CRT). In relation to avionics displays, the use of a CRT has numerous advantages. Specifically, the CRT's high luminous efficiency, superior contrast ratios and excellent viewing angles offer particular advantages to the space and aviation industries. However, in relation to electronic displays used for avionics, the CRT has two notable deficiencies. Namely, the bulk of the electron gun and the large power usage by the deflection amplifiers. Hence, in an effort to reduce the space required for electronic displays (space usage being particularly critical in aircraft and spacecraft cockpits) and to reduce the power consumption requirements, the aviation and space industries have turned to alternatives for the CRT.

One such alternative electronic display is the backlit liquid crystal display (LCD). Backlit LCD's offer display luminance efficiencies, contrast ratios and display viewing angles comparable to CRT's. In addition, unlike CRT's, backlit LCD's provide an extremely compact design, having low power requirements, that is particularly suited for avionics displays. Typically, the LCD is backlit using a fluorescent discharge lamp in which light is generated by an electric discharge in a gaseous medium.

One such known fluorescent discharge lamp 10 for backlighting a LCD 12 is illustrated in FIGS. 1–3. The fluorescent lamp 10 includes a serpentine fluorescent lamp tube 14 positioned within an interior region 15 of a lamp housing 16. The housing 16 has a transparent wall 18 contiguous with the LCD 12. The lamp tube 14 is charged with a mixture of a mercury vapor and a noble gas, and an inner surface 20 of the lamp tube 14 is coated by a phosphor. Free end portions 22 of the lamp tube 14 are mounted within insulating cups 24 mounted to the lamp housing 16. Hot cathodes 26 are mounted within the free end portions 22 of the lamp tube 14. Alternating current (AC) power is provided to the cathodes 26 through leads 28 from a power supply 30.

When the fluorescent lamp 10 is turned on, the high frequency current passed by the power supply 30 through the cathodes 26 produces an electric field inside the lamp tube 14. The electric field ionizes the noble gas within the lamp tube 14. The electrons stripped from the noble gas atoms and accelerated by the electric field collide with mercury atoms. As a result, some mercury atoms become excited to a higher energy state without being ionized. As the excited mercury atoms fall back from the higher energy state, they emit photons, predominately ultraviolet (UV) photons. These UV photons interact with the phosphor on the inner surface 20 of the lamp tube 14 to generate visible light.

The intensity of the visible light generated by the fluorescent lamp 10 depends on the mercury vapor partial pressure in the lamp tube 14. The visible light reaches its maximum intensity and the fluorescent lamp 10 operates at maximum efficiency at an optimum mercury pressure between 6 mtorr and 7 mtorr. At a mercury pressure less than the optimum mercury pressure, the light intensity of the fluorescent lamp 10 is less than maximum because the mercury atoms produce less UV photons. At a mercury pressure greater than the optimum mercury pressure, the light intensity of the fluorescent lamp 10 is also less than maximum because some of the mercury atoms collide with the UV photons generated by other mercury atoms and these UV photons do not reach the phosphor coated inner surface 20 of the lamp tube 14 and therefore, do not generate visible light.

The mercury vapor pressure increases with the temperature of the coldest spot (commonly known as "the cold spot") inside the lamp tube 14. The optimal cold spot temperature, at which the mercury pressure within the lamp tube 14 is at the optimum mercury pressure, is between 41° C. and 45° C. Therefore, to insure that the visible light output of the fluorescent lamp 10 is at a maximum and to insure that the fluorescent lamp 10 is operating at maximum efficiency (i.e., the maximum visible light output for the least power consumption), it is necessary to regulate the cold spot temperature of the lamp tube 14 to maintain the optimal cold spot temperature.

In the known fluorescent lamp 10 illustrated in FIGS. 1–3, the cold spot temperature of the lamp tube 14, and thereby the visible light output of the fluorescent lamp 10, is regulated by a thermoelectric control mechanism 31 positioned within the lamp housing 16. The control mechanism 31 includes a thermoelectric cooler (TEC) 32 which operates similar to a Peltier cooler, but uses thermoelectric couples consisting of p- and n-type semiconductor materials, rather than thermoelectric couples comprising dissimilar metals as in a Peltier cooler. A first end 33 of the TEC 32 is mounted to a heater element 34. As seen best in FIG. 3, the heater element 34 is in turn mounted to a copper cold shoe 35 which is secured to the lamp tube 14 via a thermally conductive silicone adhesive 36. The area of the lamp tube 14 at which the cold shoe 35 is attached defines the cold spot 37 of the fluorescent lamp 10. A second end 38 of the TEC 32 is secured to the lamp housing 16 via a mounting bracket 40. The TEC 32 and the heater element 34 receive direct current (DC) operational power from a power supply 42 via leads 43 and 44, respectively. When energized, the combined warmth of the heater element 34 and a heating strand 47 wrapped around the lamp tube 14 and coupled to the power supply via leads 48 enable quick, low temperature start-up of the fluorescent lamp 10, which is particularly critical in aircraft and spacecraft avionics. The control mechanism 31 further includes a thermal sensor 45 which is mounted on the cold shoe 35 and is coupled to the power supply 42 via leads 46. The thermal sensor 45 monitors the temperature of the cold shoe 35 and thereby the temperature of the cold spot 37 of the lamp tube 14; and as determined by the monitored temperature of the cold shoe 35, the thermal sensor 45 controls, in a feedback loop, operation of the power supply 42 and thereby operation of the TEC 32 and the heater element 34 to regulate the cold spot 37 temperature of the lamp tube 14 and thereby the visible light output of the fluorescent lamp 10.

Though the above described, known TEC based control mechanism adequately regulates the cold spot temperature and light output of a fluorescent lamp used to backlight a LCD, there are some disadvantages. In particular, TEC's are extremely fragile thermoelectric devices that are especially susceptible to cracking and fracturing under vibrational loads to which aircraft and spacecraft are commonly subjected. This cracking and fracturing of the TEC typically results in an inoperative cold spot control mechanism, and undependable operation of the fluorescent lamp for backlighting the LCD. In addition, because of the fragile nature of the TEC, the cold spot control mechanism incorporating the TEC is difficult and expensive to manufacture.

There is a need for improved control mechanisms for regulating the cold spot temperature and light output of fluorescent lamps used to backlight LCD's. In particular, there is a need for a durable cold spot control mechanism that, when subjected to vibration, will not easily become inoperative. In addition, the cold spot control mechanism should be relatively inexpensive and easy to manufacture.

SUMMARY OF THE INVENTION

The present invention is a control mechanism for regulating the temperature of a cold spot of a fluorescent lamp tube located within a housing. The control mechanism includes a cold spot mechanism coupled to the lamp tube and defining the cold spot for the lamp tube. The cold spot mechanism has a first portion positioned within the housing and a second portion positioned outside of the housing. A heating mechanism is contiguous with the second portion of the cold spot mechanism and operates to warm the cold spot mechanism to a substantially optimum cold spot temperature that allows the lamp tube to generate a substantially maximum intensity of light output. A power supply is coupled to the heating mechanism and delivers operational power thereto. A temperature sensing mechanism is coupled to the power supply and monitors the temperature of the cold spot mechanism. Based upon the cold spot mechanism temperature, the temperature sensing mechanism controls operation of the power supply to maintain the substantially optimum cold spot temperature of the lamp tube.

This control mechanism regulates the cold spot temperature of the fluorescent discharge lamp tube to maintain the visible light output of the lamp tube at substantially maximum intensity. In particular, since this control mechanism does not incorporate a thermoelectric cooler (TEC), the problems (i.e., undependable lamp tube operation due to the cracking and fracturing of the TEC under vibrational loads) of prior art cold spot control mechanisms associated with the fragile nature of TEC's have been eliminated. In addition, this cold spot control mechanism is relatively easy and inexpensive to manufacture.

DETAILED DESCRIPTION OF THE PREFERRED EMBODIMENTS

Figure 1:
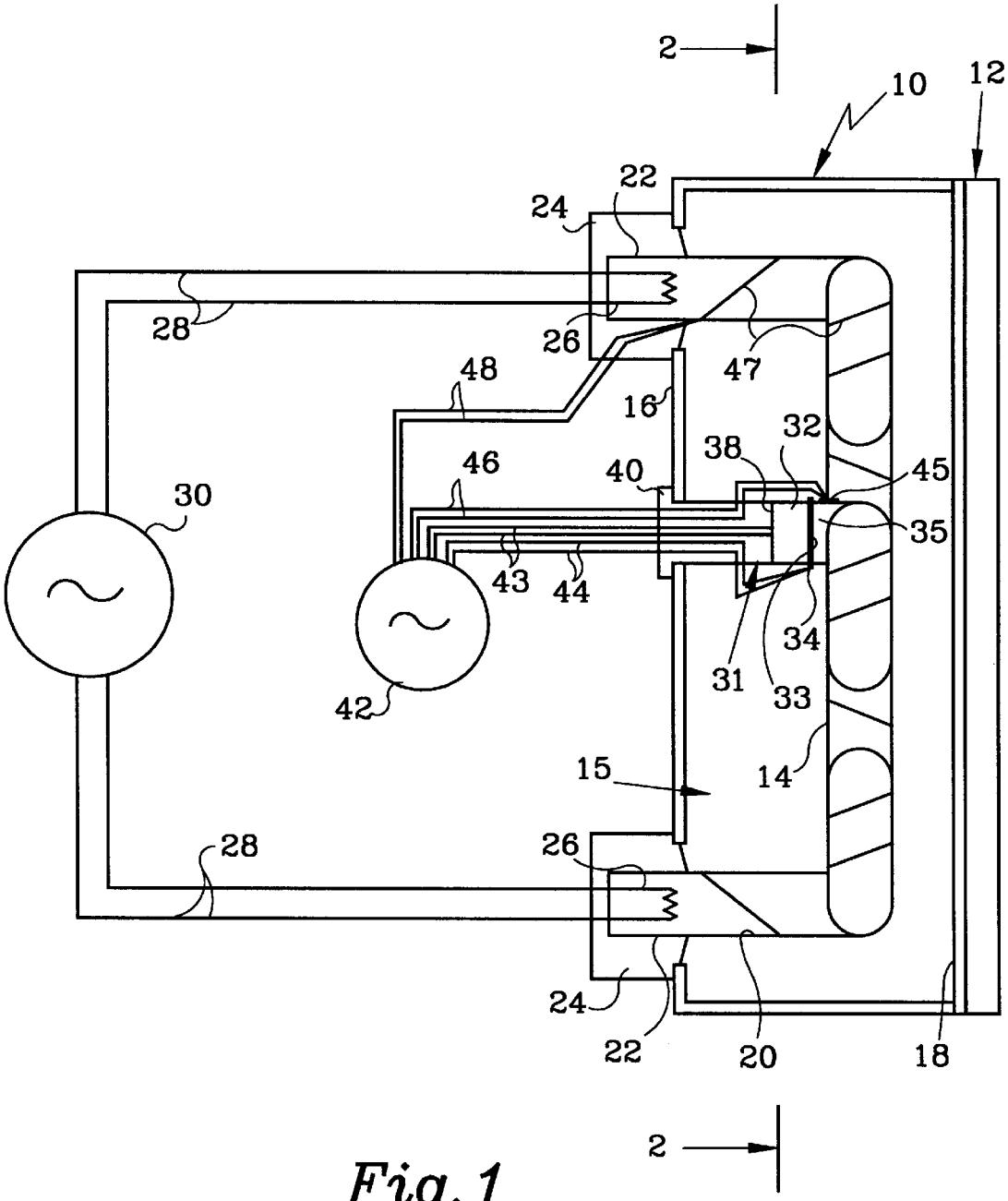
Fig. 1 (PRIOR ART)
FIG. 1 is a sectional view of a fluorescent discharge lamp for backlighting a liquid crystal display (LCD), the discharge lamp incorporating a known thermoelectric cooler (TEC) control mechanism for regulating the cold spot temperature of the discharge lamp
Figure 2:
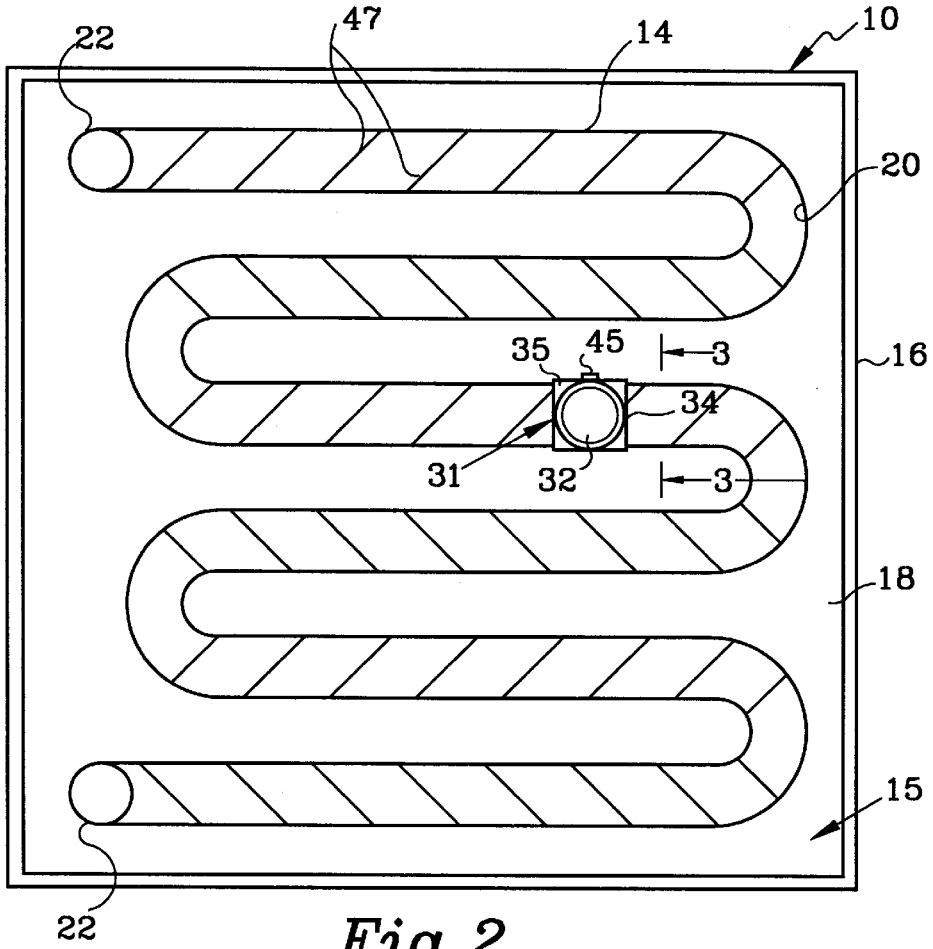
Fig. 2 (PRIOR ART)
FIG. 2 is a plan view taken along line 2—2 in FIG. 1 illustrating details of a serpentine lamp tube and the TEC control mechanism of the discharge lamp known to those skilled in the art.
Figure 3:
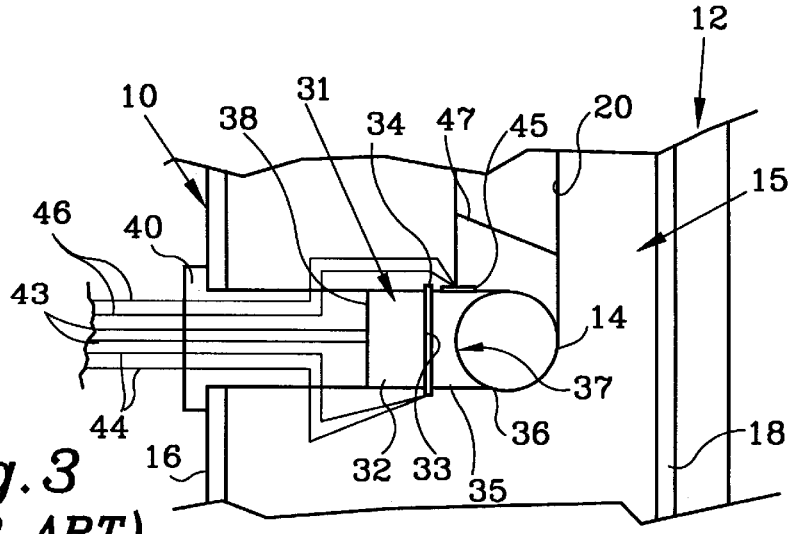
Fig. 3 (PRIOR ART)
FIG. 3 is a greatly enlarged, partial sectional view taken along line 3—3 in FIG. 2 illustrating details of the known TEC control mechanism.
Figure 4:
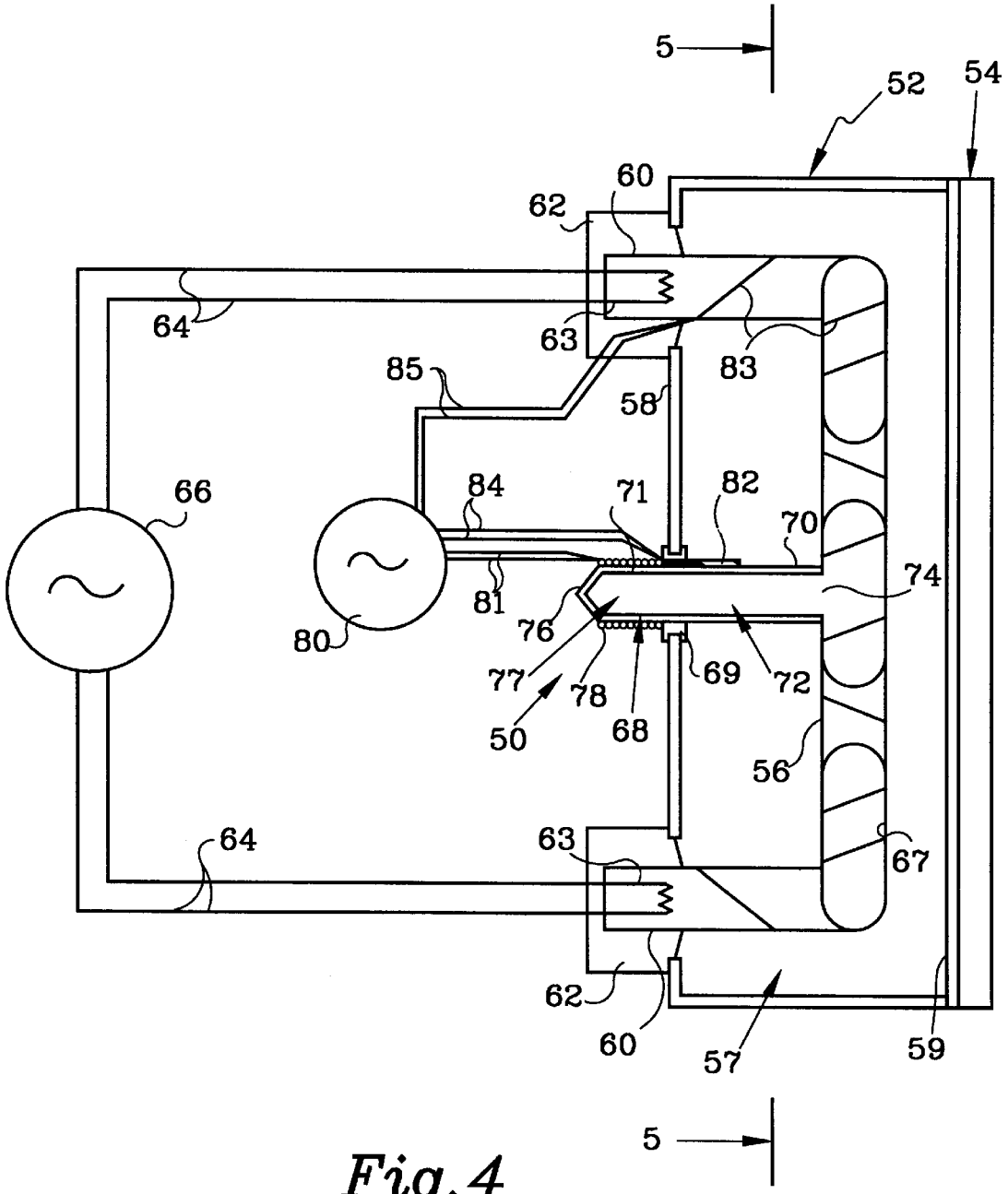
FIG. 4 is a sectional view of a fluorescent discharge lamp for backlighting a LCD, the discharge lamp incorporating a control mechanism for regulating the cold spot temperature of the discharge lamp in accordance with the present invention.
Figure 5:
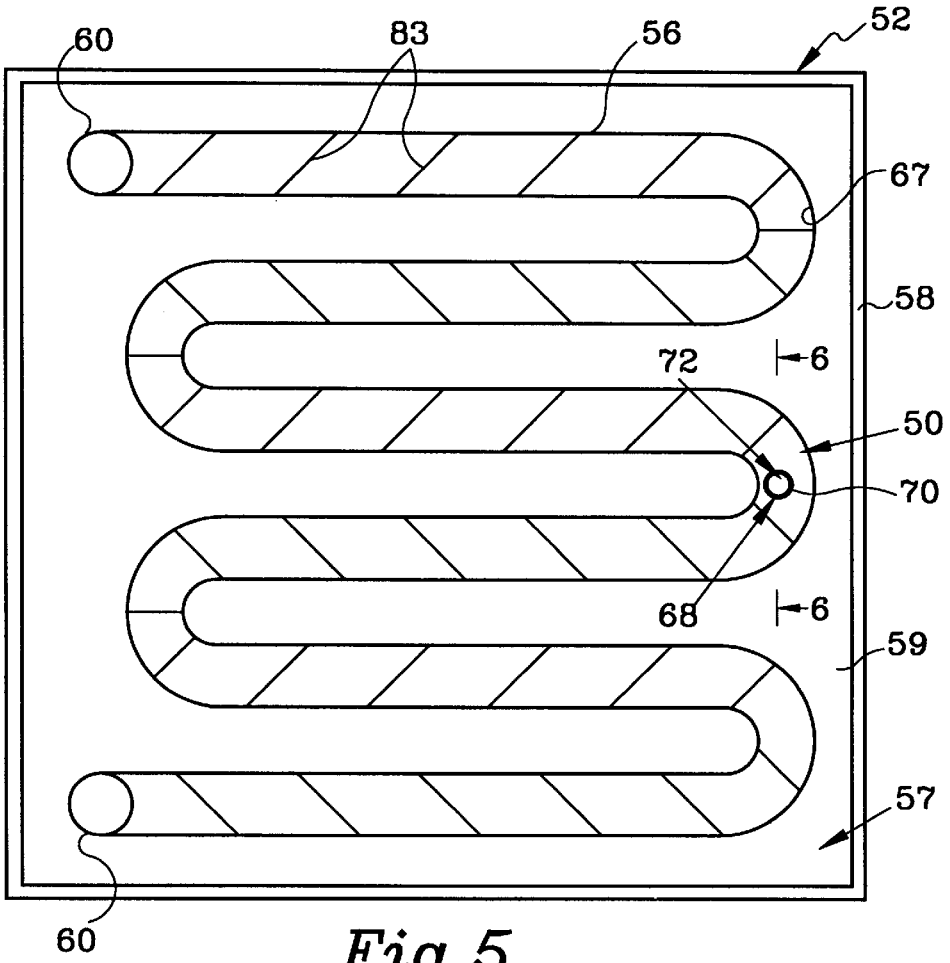
FIG. 5 is a plan view taken along line 5—5 in FIG. 4 illustrating details of a serpentine lamp tube and the control mechanism shown in FIG. 4.
Figure 6:
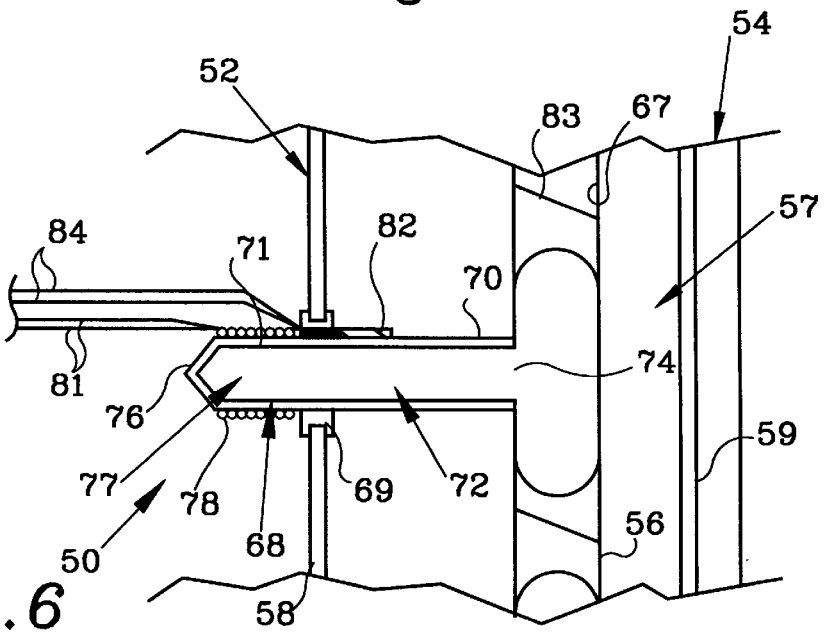
FIG. 6 is a greatly enlarged, partial sectional view taken along line 6—6 in FIG. 5 illustrating details of the control mechanism in accordance with the present invention.

A cold spot control mechanism 50 for a fluorescent discharge lamp 52 used to backlight a liquid crystal display (LCD) 54 in accordance with the present invention is illustrated generally in FIGS. 4–6. The fluorescent lamp 52 includes a serpentine fluorescent lamp tube 56 positioned within an interior region 57 of a lamp housing 58. The housing 58 has a transparent wall 59 contiguous with the LCD 54. Free end portions 60 of the lamp tube 56 are mounted within insulating cups 62 mounted to the lamp housing 58. Electrodes 63, such as hot cathodes, are mounted within the free end portions 60 of the lamp tube 56. Power, such as alternating current (AC), is provided to the electrodes 63 through leads 64 from a power supply 66.

In one preferred embodiment, the lamp tube 56 is charged with a mixture of a mercury vapor and argon, and an inner surface 67 of the lamp tube 56 is coated with a fluorophosphates. The optimal cold spot temperature of the lamp tube 56 to maintain the visible light output of the fluorescent lamp 52 lamp at substantially maximum intensity is between 41° C. and 45° C.

As seen best in FIGS. 4 and 6, the cold spot temperature of the lamp tube 56 is regulated to maintain the optimal cold spot temperature via the cold spot control mechanism 50. The control mechanism 50 includes a cold spot mechanism defined by a cylindrical shaped glass tube 68 connected, such as by welding, to the lamp tube 56. The tube 68 is further secured to the housing 58 via an insulating grommet 69. The tube 68 includes a first portion 70 positioned within the interior region 57 of the housing 58 and a second portion 71 located outside of the housing 58. An internal region 72 of the tube 68 is open, via open first end 74, to the internal gas pressure of the lamp tube 56. The tube 68 has a closed second end 76. The tube 68 defines the cold spot 77 for the lamp tube 56 of the fluorescent lamp 52. The control mechanism 50 further includes a heater wire 78 which is wrapped about the second portion 71 of the tube 68 and is coupled to a power supply 80 via leads 81; and a heating strand 83 which is wrapped about the lamp tube 56 and is coupled to the power supply 80 via leads 85. The power supply 80 delivers operational power, such as direct current (DC) to the heater wire 78 and heating strand 83. A temperature sensor 82 of the control mechanism 50 is mounted on the first portion 70 of the tube 68 and is coupled to the power supply 80 via leads 84.

In operation, adequate cooling of the cold spot 77 of the lamp tube 56 is accomplished due to the positioning of the second portion 71 of tube 68 of the control mechanism 50 in the cooler air outside of the housing 58 rather than in the warmer air within the interior region 57. Hence, the prior art need for a thermoelectric device, such as a thermoelectric cooler (TEC) has been eliminated. Upon startup of the fluorescent lamp 52 (i.e., upon energizing of the power supply 66), the temperature sensor 82 of the control mechanism 50 senses the temperature of the tube 68. If the sensed temperature is not within the optimal cold spot temperature range, the sensor 82 energizes the power supply 80 so as to deliver operational power to the heater wire 78 and heating strand 83. The heater wire 78 and heating strand 83 quickly warm the tube 68 and lamp tube 56, respectively, to a temperature within the optimal cold spot temperature range, enabling the lamp tube 56 of the fluorescent lamp 52 to quickly generate visible light at substantially maximum intensity for backlighting the LCD 54 at start-up. After start-up, the heating strand 83 is then deenergized. The sensor 82 continually monitors the temperature of the tube 68, and thereby the temperature of the cold spot 77 of the lamp tube 56 during operation of the fluorescent lamp 52, and controls, in a feedback loop, operation (i.e., the power delivery to the heater wire 78) of the power supply 80, based upon the temperature of the tube 68, to maintain (i.e., regulate) the optimal cold spot temperature for maximum intensity, visible light output by the lamp tube 56 of the fluorescent lamp 52.

Figure 7:
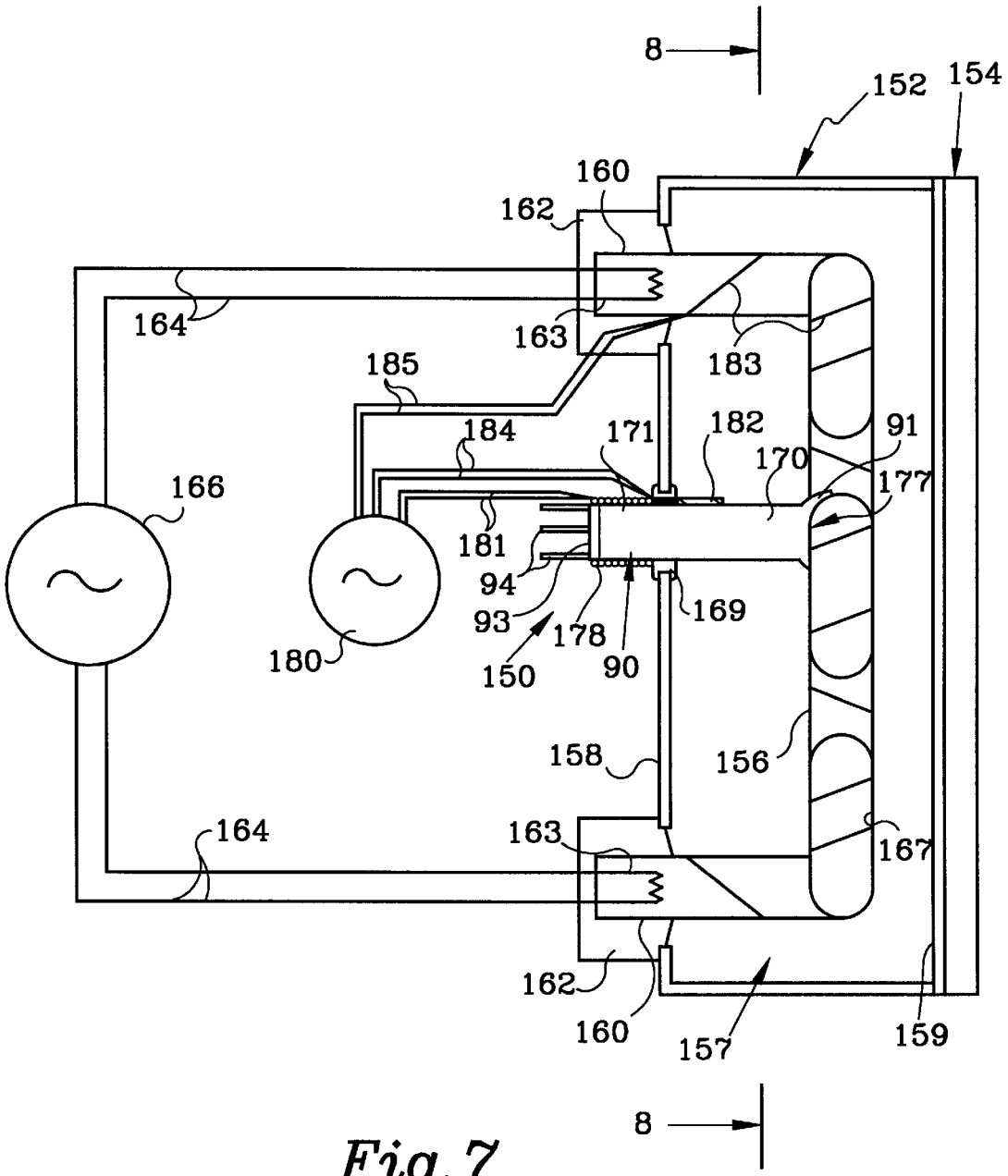
FIG. 7 is a sectional view of a fluorescent discharge lamp for backlighting a LCD, the discharge lamp incorporating an alternative embodiment of a control mechanism for regulating the cold spot temperature of the discharge lamp in accordance with the present invention.
Figure 8:
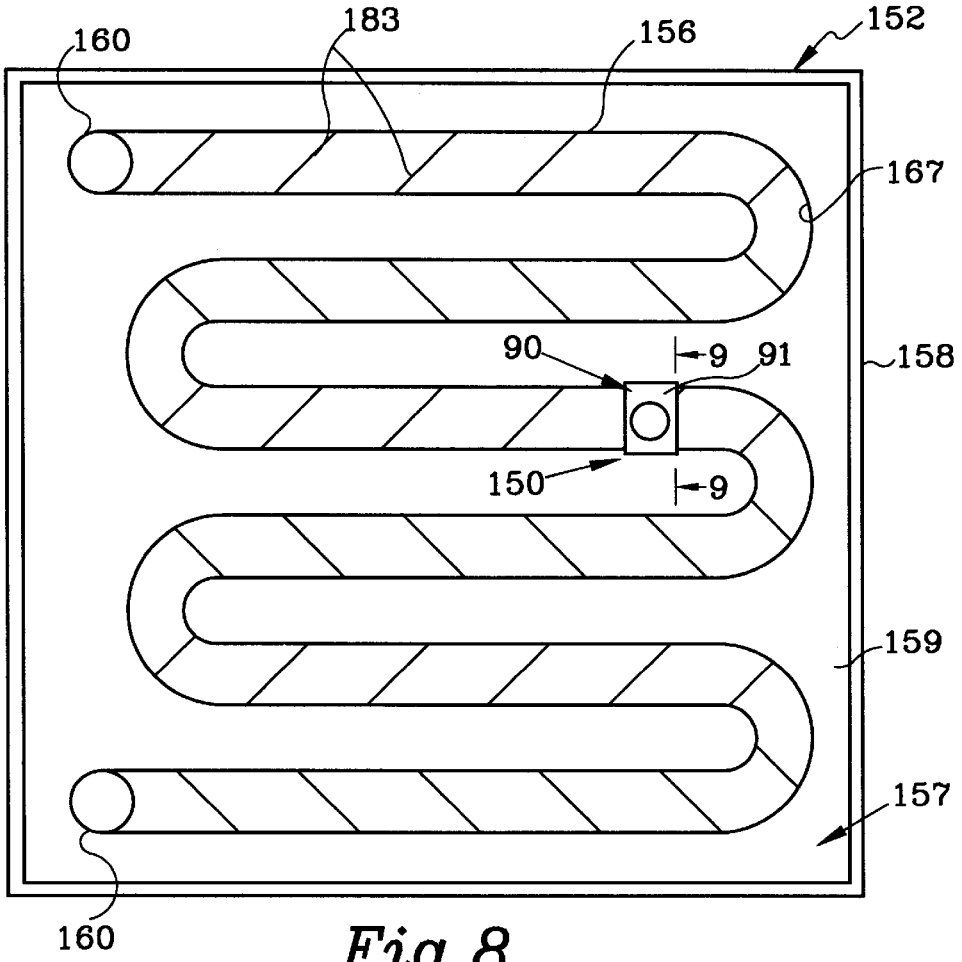
FIG. 8 is a plan view taken along line 8—8 in FIG. 7 illustrating details of a serpentine lamp tube and the alternative control mechanism shown in FIG. 7.
Figure 9:
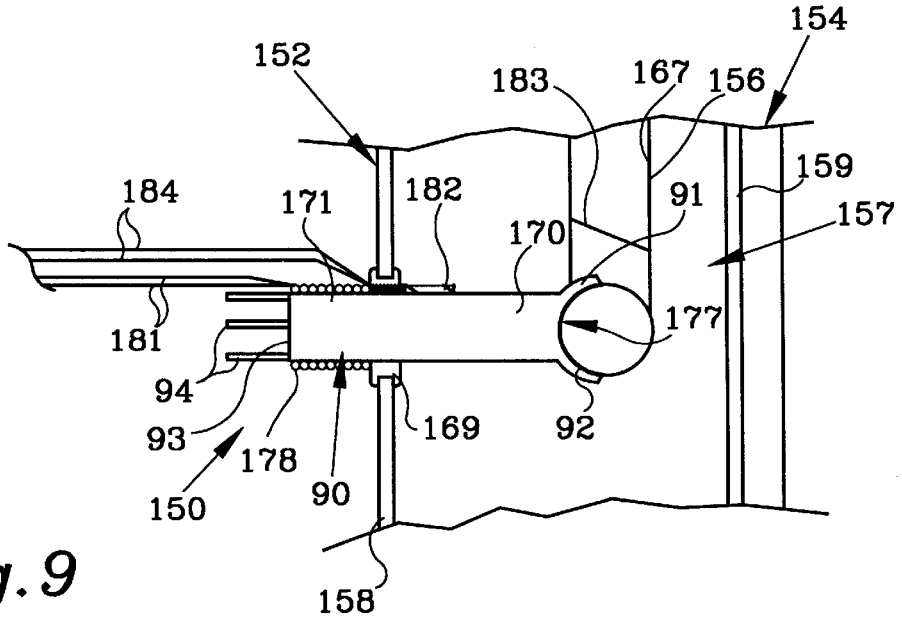
FIG. 9 is a greatly enlarged, partial sectional view taken along line 9—9 in FIG. 8 illustrating details of the alternative control mechanism in accordance with the present invention.

FIGS. 7–9 illustrate an alternative cold spot control mechanism embodiment 150. Like parts are labeled with like numerals except for the addition of the prescript 1. In the alternative control mechanism embodiment 150, the cold spot mechanism is defined by a rod 90. A first end 91 of rod 90 is shaped to fit the lamp tube 156 and is secured thereto via a thermally conductive silicone adhesive 92 (see FIG. 9). A second end 93 of the rod includes cooling fins 94. In one preferred embodiment, the rod 90 is a tin plated copper post. Operation of the components of the alternative cold spot control mechanism embodiment is substantially identical to that described above in relation to the preferred cold spot control mechanism 50.

The cold spot control mechanism 50, 150 regulates the cold spot temperature of the fluorescent discharge lamp tube 56, 156 to maintain the visible light output of the lamp tube 56, 156 at substantially maximum intensity. In particular, since the control mechanism 50, 150 does not incorporate a thermoelectric cooler (TEC), the problems (i.e., undependable lamp tube operation due to the cracking and fracturing of the TEC under vibrational loads) of prior art cold spot control mechanisms associated with the fragile nature of TEC's have been eliminated. In addition, the cold spot control mechanism 50, 150 is relatively easy and inexpensive to manufacture.

Although the present invention has been described with reference to preferred embodiments, workers skilled in the art will recognize that changes may be made in form and detail without departing from the spirit and scope of the invention. For example, though the fluorescent lamp 52, 152 has been described as having a fluorescent lamp tube, the cold spot control mechanism 50, 150 would also work with a fluorescent lamp incorporating a fluorescent "flat" lamp.

We claim:

1. A control mechanism for regulating the temperature of a cold spot of a fluorescent discharge lamp member located within a housing, the control mechanism comprising:

a cold spot mechanism coupled to the lamp member and defining the cold spot for the lamp member, the cold spot mechanism having a first portion positioned within the housing and a second portion positioned outside of the housing;

a heating mechanism contiguous with the second portion of the cold spot mechanism, the heating mechanism warming the cold spot mechanism to a substantially optimum cold spot temperature that allows the lamp member to generate a substantially maximum intensity of light output;

a power supply coupled to the heating mechanism for delivering operational power to the heating mechanism; and a temperature sensing mechanism coupled to the power supply, the temperature sensing mechanism monitoring the temperature of the cold spot mechanism and controlling operation of the power supply based upon the temperature of the cold spot mechanism to maintain the substantially optimum cold spot temperature.

2. The control mechanism of claim 1 wherein the cold spot mechanism is a tube connected to the lamp member and having an internal region that communicates with internal gas pressure of the lamp member.

3. The control mechanism of claim 2 wherein the tube is a cylindrical shaped glass tube having an open first end by which the internal region of the glass tube is open to the internal gas pressure of the lamp member and a closed second end.

4. The control mechanism of claim 2 wherein the heating mechanism is a heater wire wrapped about the second portion of the tube.

5. The control mechanism of claim 1 wherein the temperature sensing mechanism is secured to the first portion of the cold spot mechanism.

6. The control mechanism of claim 1 wherein the cold spot mechanism is a rod connected to the lamp member.

7. The control mechanism of claim 6 wherein the rod is a tin plated copper post.

8. The control mechanism of claim 6 wherein the rod is secured at a first end to an outer surface of the lamp member via a thermally conductive adhesive.

9. The control mechanism of claim 8 wherein the lamp member is a lamp tube and wherein the first end of the rod is shaped to fit the lamp tube.

10. The control mechanism of claim 6 wherein the heating mechanism is a heater wire wrapped about the second portion of the rod.

11. The control mechanism of claim 1 wherein the second portion of the cold spot mechanism includes cooling fins.

* * * * *